US009309795B2

(12) United States Patent
van der Hulst

(10) Patent No.: US 9,309,795 B2
(45) Date of Patent: Apr. 12, 2016

(54) OIL MANAGEMENT SYSTEM FOR AN INTERNAL COMBUSTION ENGINE, AND A METHOD FOR OIL MANAGEMENT OF SUCH AN ENGINE

(75) Inventor: Willem van der Hulst, Gironico Como (IT)

(73) Assignee: GROENEVELD TRANSPORT EFFICIENCY B.V., Gorinchem (NL)

( * ) Notice: Subject to any disclaimer, the term of this patent is extended or adjusted under 35 U.S.C. 154(b) by 65 days.

(21) Appl. No.: 14/342,594

(22) PCT Filed: Aug. 29, 2012

(86) PCT No.: PCT/NL2012/050589

§ 371 (c)(1),
(2), (4) Date: May 6, 2014

(87) PCT Pub. No.: WO2013/032325

PCT Pub. Date: Mar. 7, 2013

(65) Prior Publication Data

US 2014/0338632 A1 Nov. 20, 2014

(30) Foreign Application Priority Data

Sep. 2, 2011 (NL) ..... 2007335

(51) Int. Cl.
*F01M 7/00* (2006.01)
*F01M 11/06* (2006.01)

(52) U.S. Cl.
CPC ..... *F01M 7/00* (2013.01); *F01M 11/061* (2013.01)

(58) Field of Classification Search
CPC ..... F01M 11/0458; F01M 2011/0466; F01M 11/045; F01M 11/06; F01M 11/10; F16N 2230/02
USPC ..... 123/196 R, 196 S; 184/1.5, 6.5, 6.22
See application file for complete search history.

(56) References Cited

U.S. PATENT DOCUMENTS 1,401,081 A 12/1921 Howard
5,568,842 A * 10/1996 Otani ..... 184/6.22

(Continued)

FOREIGN PATENT DOCUMENTS

DE 100 62 552 A1 6/2002
FR 504 668 A 7/1920

(Continued)

OTHER PUBLICATIONS

Machine translation of JP09100711A, see "JP09100711A_ MachineTranslation.pdf" published 1997.*

(Continued)

*Primary Examiner* — Lindsay Low
*Assistant Examiner* — Long T Tran
(74) *Attorney, Agent, or Firm* — Young & Thompson

(57) ABSTRACT

Disclosed is an oil management system for an internal combustion engine that includes a crankcase. The oil management system includes a first container for storage of a first quantity of oil and a second container for temporary storage of a predetermined second quantity of oil. The oil management system further includes a pump arranged for operating in a first and a second mode, in which modes oil is transferrable respectively to and from the second container, and a flow measuring unit arranged for measuring an oil flow to or from the second container when the pump is operating. The oil management system is arranged for delivery of the predetermined second quantity of oil to the crankcase in dependence of the measured oil flow. Also described is a method for oil management of an internal combustion engine that includes a crankcase.

17 Claims, 2 Drawing Sheets

(56) References Cited

U.S. PATENT DOCUMENTS

| | | | | | |
|---|---|---|---|---|---|
| 5,685,396 | A | * | 11/1997 | Elkin et al. | 184/1.5 |
| 5,964,256 | A | * | 10/1999 | Bedi et al. | 141/83 |
| 6,079,380 | A | * | 6/2000 | Jorgensen et al. | 123/73 AD |
| 6,082,322 | A | * | 7/2000 | Graham et al. | 123/196 S |
| 6,604,497 | B2 | * | 8/2003 | Buehrle et al. | 123/90.12 |
| 6,938,585 | B2 | * | 9/2005 | Schneider | 123/1 A |

FOREIGN PATENT DOCUMENTS

| | | | | |
|---|---|---|---|---|
| FR | 1 095 226 | A | | 5/1955 |
| FR | 2 803 873 | A1 | | 7/2001 |
| JP | 1 219305 | A | | 9/1989 |
| JP | 09100711 | A | * | 4/1997 |
| JP | 11148332 | A | * | 6/1999 |

OTHER PUBLICATIONS

International Search Report, dated Nov. 20, 2012, from corresponding PCT application.

* cited by examiner

OIL MANAGEMENT SYSTEM FOR AN INTERNAL COMBUSTION ENGINE, AND A METHOD FOR OIL MANAGEMENT OF SUCH AN ENGINE

BACKGROUND OF THE INVENTION

1. Field of the Invention

The present invention relates to an oil management system for an internal combustion engine that comprises a crankcase. The present invention also relates to a method for oil management of such an engine.

2. Description of the Related Art

A large fleet of for example trucks, busses or generator sets generally comprises many different types of internal combustion engines that comprise a crankcase. This large variety of types of engines is not in the least owing to ongoing developments with respect to achieving cleaner internal combustion engines. As each type of such engines requires a specific type of oil, based on their technical standard and temperature circumstances, it has become increasingly difficult to manage oil levels of a large fleet of engines.

Furthermore, checking of an oil level in the crankcase of an engine can be quite difficult because engines for example are being operated continuously or are located at remote places or are being rented and are therefore not easily accessible for maintenance by the owner and/or maintenance personnel. In addition, as it is very difficult to predict the right moment for checking the oil level in the crankcase, typically many unnecessary checks are being carried out. Especially in the case of big fleets this gives rise to significant and in fact unnecessary costs.

A main problem with respect to oil management of an internal combustion engine comprising a crankcase is how to replenish the oil in the crankcase such that the oil level in the crankcase does not drop below a predetermined minimum level and does not exceed a predetermined maximum level. A related problem is how to reliably determine the actual oil level in the crankcase. A first source of inaccuracy with respect to determining the actual oil level in the crankcase might be waiting not long enough after the engine has been shut down before checking the oil level. In this case, not all of the oil has had a chance to flow back into the crankcase yet. Important aspects for determining a sufficiently long waiting time are type of oil used, in particular its viscosity, and temperature conditions under which the engine is operated as this has an impact on the viscosity of the oil. A second source of inaccuracy with respect to determining the actual oil level in the crankcase might be the engine not being in a level position at the time the oil level is being checked.

It is well known that an engine will get damaged if the oil level in the crankcase drops below a predetermined minimum level and a sufficient amount of oil is not replenished in due time. However, if the actual oil level in the crankcase cannot be determined reliably, it practically is a mere guess how much oil has to be replenished. In the case that an amount of oil is replenished such that a predetermined maximum oil level is exceeded the engine can also get damaged eventually as for example oil seals can start leaking due to too high pressure. In addition, excess oil in the crankcase will be burned and possibly contaminates a catalytic convertor of an exhaust system. It will be clear that such a waste of expensive oil and damage to the engine and/or to the exhaust system at least needs to be reduced.

Hence, it is important to be able to replenish the right amount of oil, i.e. an amount of oil such that the oil level in the crankcase will be between predetermined minimum and maximum levels. In addition, it is important to be able to replenish the right type of oil for each specific type of engine.

BRIEF SUMMARY OF THE INVENTION

It is a first object of the present invention to provide an oil management system that enables replenishment of the right amount and type of oil in the crankcase of an internal combustion engine in such a way that the oil level in the crankcase is between predetermined minimum and maximum levels. It is a second object of the present invention to provide a method for oil management of an internal combustion engine that comprises a crankcase.

At least one of these objects is achieved by an oil management system that comprises a first container for storage of a first quantity of oil and a second container for temporary storage of a predetermined second quantity of oil, the oil management system further comprises a pump arranged for operating in a first and a second mode, in which modes oil is transferrable respectively to and from the second container, and a flow measuring unit arranged for measuring an oil flow to or from the second container when the pump is operating, wherein the oil management system is arranged for delivery of the predetermined second quantity of oil to the crankcase of the internal combustion engine in dependence of the measured oil flow.

The crankcase of for example a big truck can comprise 15 to 20 liters of oil. The first container of the oil management system stores a first quantity of oil, for example 6 to 20 liters, which should enable the truck to span a distance of for example 100,000 kilometers before the oil needs to be changed. An advantage of such a large storage container is that during a period in which the abovementioned distance is covered a right type of oil is available for a specific type of engine and the temperature conditions under which that engine has to operate. The second container is used for temporary storage of the predetermined second quantity of oil that lies in a range of for example 0.2 to 0.8 liter, preferably is 0.5 liter. The second container is filled with oil from the first container when the pump operates in a first mode. In the first mode, which is referred to as sucking phase, the pump sucks oil from the first into the second container. The pump is for example an electrically driven gear pump, which can easily change turning direction.

When the second container is full, the pump is switched to a second mode of operation. In the second mode, which is referred to as pressing phase, the pump transfers the predetermined second quantity of oil, preferably 0.5 liter, to the crankcase of the internal combustion engine. As a result, it is possible to maintain the oil level in the crankcase in a controlled way at an optimal level between predetermined minimum and maximum levels by replenishing the oil in the crankcase as described above in one or more cycles.

Another advantage of replenishing the oil in the crankcase with small amounts, i.e. amounts that lie in a range of for example 0.2 to 0.8 liter, preferably are 0.5 liter, is that pollution of the oil can be reduced better than in the case that large amounts of oil, i.e. amounts that lie in a range of for example 2 to 4 liters, are replenished at once.

The flow measuring unit enables determining the time required to fill or empty the second container independently of temperature and type of oil, in particular viscosity, used. In this way a disadvantageous predetermined pumping time can be avoided.

When using a predetermined pumping time, a first possible situation could occur in which for example due to a lower viscosity of the oil than expected, the second container would not be filled to a predetermined level, for example a maximum level, at the end of the predetermined pumping time. In this situation, the actual amount of oil in the second container could be unknown. Consequently, an insufficient amount of oil would be transferred from the second container to the crankcase. Eventually, this could lead to problems if the oil level drops below a predetermined minimum oil level in the crankcase.

In a second possible situation, the actual amount of oil in the second container could be known if sensors at predetermined levels would be provided. Such sensors could at least give an estimate of the amount of oil present in the second container. Based on this information additional pump time could be calculated in order to fill the second container to a predetermined level, for example to a maximum level. After switching the pump from the first mode of operation to the second mode of operation the content of the second container could be transferred to the crankcase. However, complexity, cost and chance of failure of the oil management system would increase because of the need for additional and/or more complex sensors and/or increased capability of software and control electronics.

In a case that the viscosity of the oil is higher than expected, the second container would be filled until the predetermined level, for example the maximum level, before the end of the predetermined pumping time. Reaching of the latter level should be detected and a control signal should be sent to the gear pump either to turn it off in order to prevent damage in particular to the pump and/or to the second container because of too high a pressure exerted by the compressed oil, or to switch the pump into the second mode of operation in which it transfers oil from the second container to the crankcase. In order to prevent damage due to possible overfilling of the second container and to enable venting, a third tube can be provided between the first and the second container. Excess oil can flow from the second container into the first container via the third tube. When the pump is in the pressing phase, the third tube enables venting of the second container.

Reaching of a predetermined minimum level should also be detected and a control signal should be sent to the pump either to turn it off in order to prevent damage in particular to the gear pump because of oil shortage as the gear pump should continuously be submerged in oil, or to switch the pump into the first mode of operation in which it transfers oil from the first container to the second container.

In a case that the viscosity of the oil is much lower than expected or that no oil is available, the pump is switched off if no control signal is received a predetermined time interval after switching on the pump.

In an embodiment of the oil management system according to the present invention, the flow measuring unit comprises a first sensor for detecting a predetermined first oil level between a minimum and a maximum oil level in the second container. Upon detection of the predetermined first oil level in the second container a first time interval, which was required for transferring the oil from the first to the second container and for reaching the predetermined first level in the second container, is known. The oil flow can easily be calculated. Consecutively, a second time interval, which is required for filling the second container until the predetermined maximum level, can be calculated. After the second time interval the predetermined maximum oil level in the second container is reached and the pump is switched off and/or switched into its second mode of operation in which it pumps oil from the second container towards the crankcase of the internal combustion engine.

The first sensor could also be constructed and arranged such that it starts measuring the oil level in the second container after switching on the pump in the first mode of operation. Upon reaching of the predetermined first oil level in the second container the first time interval is known and the oil flow can be calculated. At the end of the second time interval the pump can be switched off and/or switched to its second mode of operation.

An advantage of measuring the oil flow when the pump is operating, is that it suffices to provide a single sensor. This reduces the complexity and thereby the costs of the oil management system. The single sensor can practically be arranged at any position between the predetermined minimum and maximum oil levels. As the actual position of the single sensor with respect to the predetermined minimum and maximum oil levels is known, the second time interval can be calculated. Preferably, the single sensor is arranged in the second container halfway between the predetermined minimum and maximum oil levels. In this case, the second time interval is equal to the first time interval.

In the case that a disadvantageous predetermined pumping time is used at least two sensors would be required, i.e. a sensor for determining a predetermined minimum oil level in the second container and another sensor for determining a predetermined maximum oil level in the second container. Upon detection of the predetermined minimum oil level in the second container, the gear pump should be turned off in order to prevent it from being damaged because of oil shortage as the gear pump should continuously be submerged in oil. Alternatively, the gear pump could be switched into the first mode of operation in which oil from the first container is transferred to the second container. Upon detection of the predetermined maximum oil level in the second container, the gear pump should be turned off in order to prevent it from being damaged because of too high a pressure exerted by the compressed oil. Alternatively, the gear pump could be switched into the second mode of operation in which oil from the second container is transferred to the crankcase.

Another advantage of placing the first sensor at a position not higher than halfway the predetermined minimum and maximum oil levels is that feedback about filling of the second container is available earlier than in a case when the sensor would be placed higher. In particular, in this case it is possible to limit suction time of the pump in the case that the first container is empty in order to avoid damage to the pump as a result of running without oil.

In an embodiment of the oil management system according to the present invention, the oil management system is connectable to an engine management system for providing a first trigger to the oil management system. The oil management system needs to receive a trigger in order to start replenishment of the oil in the crankcase. A first trigger can be provided by data from the engine management system. Such data can comprise mileage over a predetermined period of time, running hours and signals from an oil level sensor in the crankcase, a heat sensor and/or a pressure indicator. By connecting the engine management system with the oil management system this data is exchangeable. A Can-Bus communication system can be used for this.

In an embodiment of the oil management system according to the present invention, the oil management system is connectable to a second sensor that is arranged for measuring a second oil level in the crankcase of the internal combustion engine and providing a second trigger to the oil management system. The second sensor can be an external sensor based on the principle of communicating vessels. For optimum operation of the engine the second oil level in the crankcase should be maintained between predetermined minimum and maximum levels. Depending on the preferred oil replenishment strategy, the second sensor provides a second trigger to the oil management system to start the replenishment of oil in the crankcase. The second trigger can be used alone when there is no first trigger provided by the engine management system. Replenishment of the oil in the crankcase can be done in one or more of the above described cycles.

In an embodiment of the oil management system according to the present invention, when the pump is operating in the first mode, oil is transferrable from the first container to the second container via a first tube that is constructed and arranged for preventing oil from flowing back into the first container. The first tube is provided with a first non-return mechanism, e.g. a non-return valve, that prevents oil after passing this valve from flowing back into the first container when the pump is switched from the first mode of operation into the second mode of operation, i.e. from the sucking phase into the pressing phase. It will be clear to a person skilled in the art that many configurations of the first tube for preventing oil from flowing back into the first container can be envisaged without departing from the scope of the present invention.

In an embodiment of the oil management system according to the present invention, when the pump is operating in the second mode, oil is transferrable from the second container towards the crankcase of the internal combustion engine via a second tube that is constructed and arranged for preventing oil from flowing back into the second container. The second tube is provided with a second non-return mechanism, e.g. a non-return valve, that prevents oil after passing this valve from flowing back into the second container when the pump is switched from the second mode of operation into the first mode of operation, i.e. from the pressing phase into the sucking phase. The second non-return mechanism needs to be closed when the pump is in the sucking phase in order to avoid oil from the crankcase from being pumped back into the second container. It will be clear to a person skilled in the art that many configurations of the second tube for preventing oil from flowing back into the second container can be envisaged without departing from the scope of the present invention.

In an embodiment of the oil management system according to the present invention, the oil management system comprises a third sensor arranged for measuring a third oil level in the first container. In this way the amount of oil left in the first container can be monitored. The oil management system could first check if a sufficient amount of oil is present in the first container before it starts an oil replenishment cycle. If the amount of oil left in the first container is insufficient, a signal can be provided that the first container needs to be replenished with the right type of oil.

In an embodiment of the oil management system according to the present invention, the oil management system comprises an electrical connector arranged for supplying power to the oil management system.

In an embodiment of the oil management system according to the present invention, the electrical connector is arranged for interfacing with the engine management system, the first, second and/or third sensors. In this way the electrical connector can also be used for exchanging data and/or control signals, which can be analog and/or digital, between the oil management system and the engine management system, the first, second and/or third sensors. The Can-Bus communication system can be used for this data exchange.

In an embodiment of the oil management system according to the present invention, the pump is a gear pump. Such a pump is very convenient for transferring fluids with a certain viscosity, for example oil, as it can generate sufficient pressure which is needed in the case that long supply lines have to be applied for interconnecting the second container and the crankcase of the engine. It will be clear to a person skilled in the art that many configurations of the gear pump can be envisaged without departing from the scope of the present invention.

According to another aspect of the present invention, a method is provided for oil management of an internal combustion engine that comprises a crankcase. The method comprises:

determination of a predetermined oil level in the crankcase of the internal combustion engine, pumping of oil from a first container comprising a first quantity of oil to a second container for temporarily storing a predetermined second quantity of oil, measurement of an oil flow to or from the second container when the pump is operating, delivery of the predetermined second quantity of oil from the second container to the crankcase of the internal combustion engine in dependence of the measured oil flow.

By applying this method, the crankcase of an engine can be replenished with a predetermined amount of oil that for example corresponds with the content of the second container. Depending on the oil replenishment strategy, the method described above can be repeated several times. This is particularly advantageous for replenishing small amounts, i.e. amounts that lie in a range of for example 0.2 to 0.8 liter. Hence, it is possible to replenish the oil in the crankcase in a cyclic way.

BRIEF DESCRIPTION OF THE DRAWINGS

The invention will be explained in more detail below with reference to drawings in which an illustrative embodiment of the invention is shown. The person skilled in the art will realize that other alternatives and equivalent embodiments of the invention can be conceived and reduced to practice without departing from the scope of the present invention.

The figures are not necessarily drawn to scale. In the figures identical components are denoted by the same reference numerals.

DETAILED DESCRIPTION OF THE PREFERRED EMBODIMENTS

Figure 1:
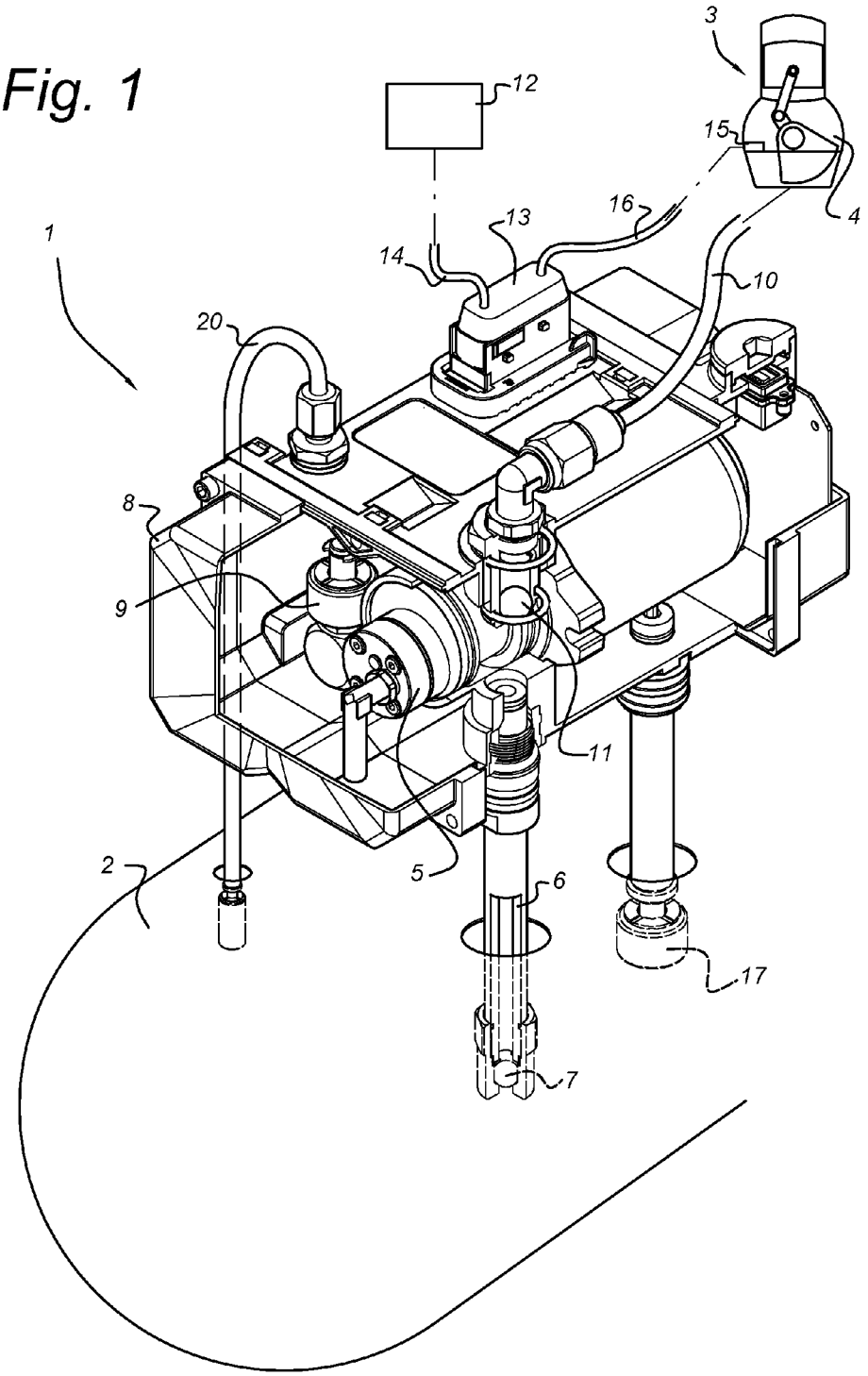
FIG. 1 shows a schematic perspective view of an embodiment of an oil management system according to the present invention, wherein of some components of the system at least a part partially has been cut away in order to show how several components are internally arranged.

FIG. 1 shows that the embodiment of the oil management system 1 according to the present invention comprises a first container 2 in which a first quantity of oil can be stored. In an oil management system 1 of an engine 3 comprising a crankcase 4 of for example a truck, the first container 2 can have a volume in a range of 6 to 20 liters. Having such a volume in storage, the truck should be able to span a distance of for example 100,000 kilometers before the oil needs to be changed. An advantage of such a large storage container 2 is that during a trip a right type of oil is available for a specific type of engine and the temperature conditions under which that engine 3 has to operate.

The first container 2 is connected to a pump 5, for example an electrically driven gear pump, via a first tube 6 that comprises a first non-return valve 7 that is arranged for preventing oil that has passed it from flowing back into the first container 2 when the pump 5 is switched from a first mode of operation into a second mode of operation, i.e. from the sucking phase into the pressing phase. In the first mode of operation, i.e. in the sucking phase, the gear pump 5 is arranged for transferring oil from the first container 2 into a second container 8. The second container 8 is used for temporary storage of a predetermined second quantity of oil that lies in a range of for example 0.2 to 0.8 liter, preferably is 0.5 liter. In order to prevent damage due to possible overfilling of the second container 8 and to enable venting, a third tube 20 is provided between the first 2 and the second 8 container. Excess oil can flow from the second container 8 into the first container 2 via the third tube 20. When the pump 5 is in the pressing phase third tube 20 enables venting of the second container 8.

The oil management system 1 further comprises a flow measuring unit that comprises a first sensor 9 for detecting a predetermined first oil level between a minimum and a maximum oil level in the second container 8. The minimum level can be equal to any suitable predetermined level, for example when the second container 8 is empty. The same holds for the maximum level, for example when the second container 8 is completely full. In the illustrative embodiment of the present invention shown in FIG. 1, the first sensor 9 is a single level switch that is arranged halfway between the predetermined minimum and maximum oil levels in the second container 8. When the oil transferred into the second container 8 reaches the level switch 9, the flow measuring unit determines a first time interval, which was required for filling the second container 8 until the level switch 9 is reached, and the oil flow is calculated. Consecutively, a second time interval, which is required for filling the second container 8 until the predetermined maximum level, can be calculated. After the second time interval, the predetermined maximum oil level in the second container 8 is reached and the pump 5 is switched off and/or switched into its second mode of operation in which it pumps oil from the second container 8 towards the crankcase 4 of the internal combustion engine 3. In this way it is possible to fill the second container 8 independently of temperature and type of oil, in particular viscosity, used.

It will be clear to the person skilled in the art that the first sensor 9 can practically be arranged at any position between the predetermined minimum and maximum oil levels in the second container 8. As the actual position of the single sensor 9 with respect to the predetermined minimum and maximum oil levels is known, the second time interval can be calculated.

The gear pump 5 is connected to the crankcase 4 of the engine 3 via a second tube 10. In the second mode of operation, i.e. the pressing mode, the gear pump 5 is arranged for transferring oil from the second container 8 into the crankcase 4 of the engine 3. The second tube 10 comprises a second non-return valve 11 that is arranged for preventing oil that has passed it from flowing back into the second container 8 when the pump 5 is switched from the second mode of operation, i.e. the pressing phase, into the first mode of operation, i.e. the sucking phase. The second non-return valve 11 needs to be closed when the pump is in the sucking phase in order to avoid oil from the crankcase 4 from being pumped back into the second container 8.

The second container 8 can be emptied by switching on the gear pump 5 in the second mode of operation, i.e. in the pressing phase, until the level switch 9 is reached. When this happens, the flow measuring unit calculates the oil flow and a fourth time interval that will be required for emptying the second container 8 until the predetermined minimum level. By switching on the pump 5 in the second mode of operation during the fourth time interval the second container 8 can be emptied until reaching the predetermined minimum level. In this way it is possible to determine the time required to empty the second container 8 independently of temperature and type of oil used or resistance in the second tube 10, due to its length and/or due to crankcase contra pressure. In addition, it will be clear to the person skilled in the art that the predetermined minimum level of oil in the second container 8 should be such that the gear pump 5 remains continuously submerged in oil in order to prevent damage to the pump 5.

For replenishing the oil in the crankcase 4 of the engine 3, the oil management system 1 needs to receive a trigger. A first trigger can be provided by an engine management system 12 that is connected an electrical connector 13 via a first communication link 14. The first communication link 14 can be part of a communication system, for example a Can-Bus communication system that establishes data exchange between the engine management system 12 and the oil management system 1 according to the present invention.

A second trigger to the oil management system 1 can be provided by a second sensor 15 that is arranged for measuring a second oil level in the crankcase 4 of the internal combustion engine 3 via a second communication link 16. For optimum operation of the engine 3 the second oil level in the crankcase 4 should be maintained at an optimal level between predetermined minimum and maximum levels. Depending on the preferred oil replenishment strategy, the second sensor 15 provides a second trigger to the oil management system 1 to start the replenishment of oil in the crankcase 4. The second trigger can be used alone when there is no first trigger provided by the engine management system 12.

Before actually starting an oil replenishment cycle, the oil management system 1 could first check whether a sufficient amount of oil is present in the first container 2. This can be determined by a third sensor 17 that is arranged for measuring a third oil level in the first container 2. If the amount of oil left in the first container 2 is insufficient, a signal can be provided that the first container 2 needs to be replenished with the right type of oil for the engine 3.

In the embodiment of the present invention shown in FIG. 1, the electrical connector 13 is arranged both for supplying power to the oil management system 1 and for interfacing with the engine management system 12, the first 9, second 15 and third 17 sensors. Data exchange between these components of the oil management system 1 can be established by for example a Can-Bus communication system.

Figure 2:
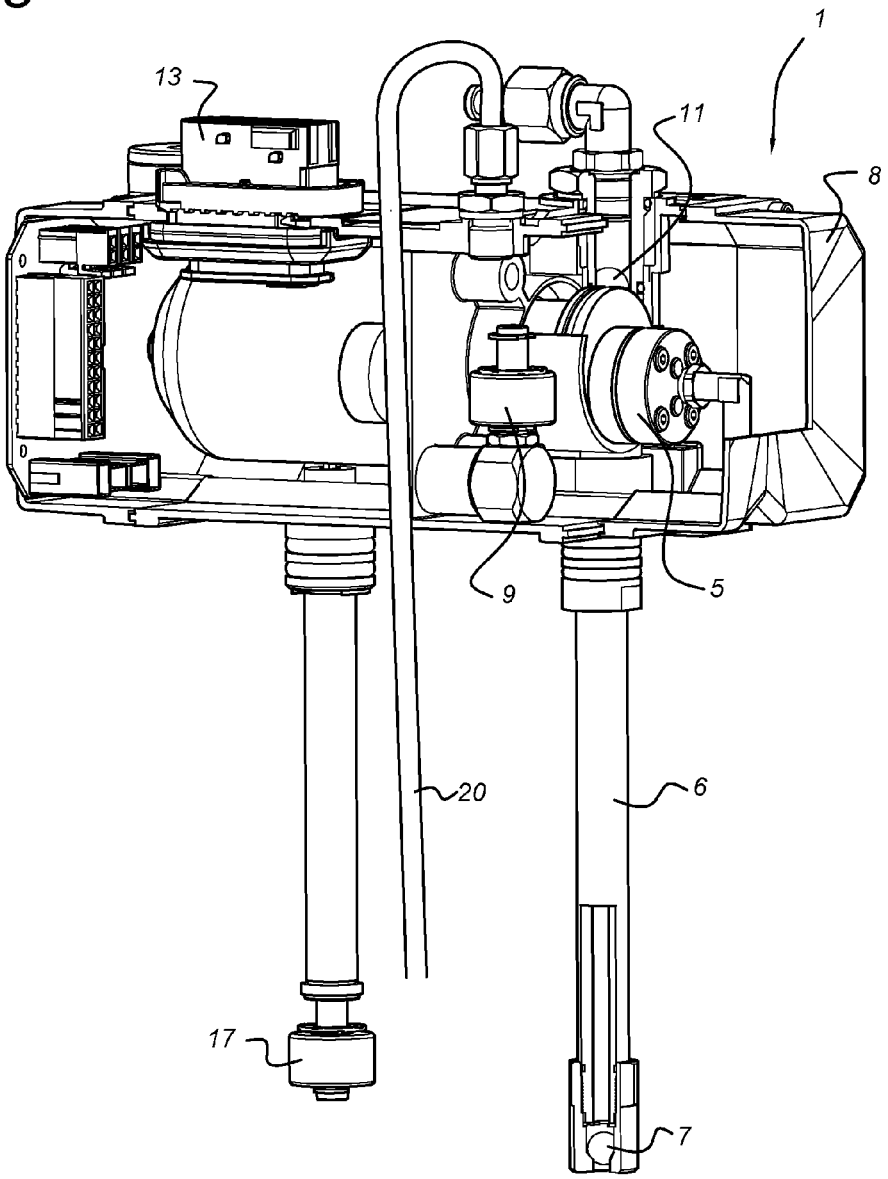
FIG. 2 shows the oil management system according to FIG. 1 from a different view point.

FIG. 2 shows the oil management system 1 according to FIG. 1 from a different view point. In this way it can better be seen that the first sensor 9 is arranged halfway between the predetermined minimum and maximum levels of the second container 8.

Software controlling the oil management system 1 is implemented such that protocols are in place for determining what action should be taken as a result of receipt of a very early or a very late signal from either the engine management system 12 and/or the first 9, second 15 and/or third 17 sensors or in the case that no signal is received at all.

Variations on the embodiment of the oil management system 1 as shown in FIGS. 1 and 2 are imaginable without diverting from the main notion of the invention. It will be clear that the invention is described by using a preferred embodiment. The invention is not intended to be limited to this embodiment. The scope of protection sought is determined by the following claims within the scope of which many modifications can be envisaged.

The invention claimed is:

1. An oil management system for an internal combustion engine that includes a crankcase, the oil management system comprising:

a first container for storage of a first quantity of oil;

a second container for temporary storage of a predetermined second quantity of oil;

a pump configured to operate in a first mode and a second mode, oil being transferrable respectively to and from the second container in the first and second modes; and a flow measuring unit configured to measure an oil flow to or from the second container when the pump is operating, the flow measuring unit including a first sensor configured to detect a predetermined first oil level between a minimum oil level and a maximum oil level in the second container, the flow measuring unit being configured, when the pump is operating in the first mode of operation, to:

determine a first time interval required for the oil level in the second container to reach the predetermined first oil level, calculate an incoming oil flow to the second container using the predetermined first oil level and the first time interval, consecutively calculate a second time interval required for the oil level in the second container to reach the maximum oil level, and one or more of switch off the pump, and switch the pump into the second mode of operation, when the oil level reaches the maximum oil level, and wherein the oil management system is configured to deliver the predetermined second quantity of oil to the crankcase of the internal combustion engine depending on the measured oil flow.

2. The oil management system according to claim 1, wherein the oil management system is connectable to an engine management system configured to provide a first trigger to the oil management system.

3. The oil management system according to claim 2, wherein the oil management system is connectable to a second sensor that is configured to measure a second oil level in the crankcase of the internal combustion engine and provide a trigger to the oil management system.

4. The oil management system according to claim 2, wherein when the pump is operating in the first mode, oil is transferrable from the first container to the second container via a first tube that is configured to prevent oil from flowing back into the first container.

5. The oil management system according to claim 4, wherein when the pump is operating in the second mode, oil is transferrable from the second container towards the crankcase of the internal combustion engine via a second tube that is configured to prevent oil from flowing back into the second container.

6. The oil management system according to claim 1, wherein the oil management system is connectable to a second sensor that is configured to measure a second oil level in the crankcase of the internal combustion engine and provide a trigger to the oil management system.

7. The oil management system according to claim 6, further comprising a third sensor a third oil level in the first container.

8. The oil management system according to claim 6, wherein when the pump is operating in the first mode, oil is transferrable from the first container to the second container via a first tube that is configured to prevent oil from flowing back into the first container.

9. The oil management system according to claim 8, wherein when the pump is operating in the second mode, oil is transferrable from the second container towards the crankcase of the internal combustion engine via a second tube that is configured to prevent oil from flowing back into the second container.

10. The oil management system according to claim 1, wherein when the pump is operating in the first mode, oil is transferrable from the first container to the second container via a first tube that is configured to prevent oil from flowing back into the first container.

11. The oil management system according to claim 10, wherein when the pump is operating in the second mode, oil is transferrable from the second container towards the crankcase of the internal combustion engine via a second tube that is configured to prevent oil from flowing back into the second container.

12. The oil management system according to claim 1, further comprising an electrical connector configured to supply power to the oil management system.

13. The oil management system according to claim 1, wherein the oil management system is connectable to an engine management system configured to provide a first trigger to the oil management system, the oil management system is connectable to a second sensor configured to measure a second oil level in the crankcase of the internal combustion engine and provide a second trigger to the oil management system, the oil management system further comprising a third sensor configured to measure a third oil level in the first container, and an electrical connector configured to supply power to the oil management system;

wherein the electrical connector is configured to interface with one or more of the engine management system, the first sensor, the second sensor, and the third sensor.

14. The oil management system according to claim 1, wherein the pump is a gear pump.

15. The oil management system according to claim 1, wherein when the pump is in the second mode of operation, the flow measuring unit is configured to:

determine a third time interval required for the oil level in the second container to reach the predetermined first oil level, calculate an outgoing oil flow from the second container using the predetermined first oil level and the third time interval, consecutively calculate a fourth time interval required for the oil level in the second container to reach the minimum oil level, and one or more of switch off the pump and switch the pump into the first mode of operation when the oil level reaches the minimum oil level.

16. A method for oil management of an internal combustion engine that includes a crankcase, the method comprising:

determining a predetermined oil level in the crankcase of the internal combustion engine;

providing a first container and a second container in fluid communication with each other, the first container including a first quantity of oil, the second container configured to temporarily store a predetermined second quantity of oil;

providing a pump that is configured to operate in a first mode and a second mode, oil being transferable respectively to and from the second container in the first and second modes;

providing a flow measuring unit configured to measure an oil flow to or from the second container when the pump is operating, the flow measuring unit including a first sensor configured to detect a predetermined first oil level between a minimum oil level and a maximum oil level in the second container;

when the pump is operating in the first mode of operation, determining, by the flow measuring unit, a first time interval required for the oil level in the second container to reach the predetermined first oil level, calculating, by the flow measuring unit, the oil flow to the second container using the predetermined first oil level and the first time interval, consecutively calculating, by the flow measuring unit, a second time interval required for the oil level in the second container to reach the maximum oil level, and one or more of switching off the pump, and switching the pump into the second mode of operation, by the flow measuring unit, when the oil level reaches the maximum oil level; and delivering the predetermined second quantity of oil from the second container to the crankcase of the internal combustion engine depending on the measured oil flow.

17. The method according to claim 16, further comprising, when the pump is in the second mode of operation, determining, by the flow measuring unit, a third time interval required for the oil level in the second container to reach the predetermined first oil level, calculating, by the flow measuring unit, an outgoing oil flow from the second container using the predetermined first oil level and the third time interval, consecutively calculating, by the flow measuring unit, a fourth time interval required for the oil level in the second container to reach the minimum oil level, and one or more of switching off the pump and switching the pump into the first mode of operation by the flow measuring unit when the oil level reaches the minimum oil level.

* * * * *